US011796273B2

(12) United States Patent
Barnes

(10) Patent No.: US 11,796,273 B2
(45) Date of Patent: Oct. 24, 2023

(54) SHOOTING ASSIST PLATFORM

(71) Applicant: Matthew E. Barnes, Farmington, NY (US)

(72) Inventor: Matthew E. Barnes, Farmington, NY (US)

( * ) Notice: Subject to any disclaimer, the term of this patent is extended or adjusted under 35 U.S.C. 154(b) by 0 days.

(21) Appl. No.: 17/728,454

(22) Filed: Apr. 25, 2022

(65) Prior Publication Data

US 2022/0349669 A1 Nov. 3, 2022

Related U.S. Application Data

(60) Provisional application No. 63/181,406, filed on Apr. 29, 2021.

(51) Int. Cl.
*F41A 23/02* (2006.01)

(52) U.S. Cl.
CPC ..... *F41A 23/02* (2013.01)

(58) Field of Classification Search
CPC ..... F41A 23/02
USPC ..... 42/94
See application file for complete search history.

(56) References Cited

U.S. PATENT DOCUMENTS

| | | | | |
|---|---|---|---|---|
| 4,991,265 | A * | 2/1991 | Campbell | B65D 63/1027 24/129 R |
| 8,087,195 | B2 * | 1/2012 | Minges | A01M 31/02 248/230.8 |
| 8,813,407 | B1 * | 8/2014 | Sargent | F41A 23/16 89/37.04 |
| 9,149,009 | B2 * | 10/2015 | Edgington | A01G 13/00 |
| 9,499,317 | B2 * | 11/2016 | Comaniuk | F16L 3/137 |
| 10,408,380 | B2 * | 9/2019 | Edgington | B42F 5/00 |
| 2010/0018102 | A1 * | 1/2010 | Minges | A47B 96/027 248/218.4 |

* cited by examiner

*Primary Examiner* — Jonathan C Weber
(74) *Attorney, Agent, or Firm* — Bennet K. Langlotz; Langlotz Patent & Trademark Works, LLC

(57) ABSTRACT

A rifle support comprises a leash with a loop end, an opposed free end, and an intermediate portion. The leash has a width and a plurality of spaced apart stoppers sized larger than this width. A hook comprises a suspension panel portion and a support portion offset from the suspension panel portion. The support portion includes an upward facing support surface when the suspension portion is vertical. The suspension panel has an elongated side edge and an upper end and a slot entering at the side edge. The slot width is greater that the leash but smaller than the stopper so as to admit the leash while denying passage of the stopper. The leash may be girded around a tree with its intermediate portion passing through the loop and the free end depending downward, with the hook slot receiving the leash and stopped a stopper.

9 Claims, 5 Drawing Sheets

SHOOTING ASSIST PLATFORM

CROSS-REFERENCE TO RELATED APPLICATIONS

This application claims the benefit of U.S. Provisional Patent Application No. 63/181,406, filed on Apr. 29, 2021, entitled "TACTICO AMIGO SHOOTING ASSIST PLATFORM", which is hereby incorporated by reference in its entirety for all that is taught and disclosed therein.

FIELD OF THE INVENTION

The present invention relates to a field portable rifle support or rifle rest for supporting a portion of the weight of a rifle by its stock, forestock, or barrel.

BACKGROUND AND SUMMARY

For best accuracy in recreational shooting for sports, hunting and target practice, the rifle must be well supported and its point of aim must be physically stabilized by a shooter especially during aiming, trigger pull, the recoil of a shot, and also for a short additional duration called "follow-through" after the bullet emerges from the muzzle, because combustion gases escaping the "uncorked" barrel act like a rocket impulse force as they depressurize.

Unlike military or combat shooters who are more inured to physical discomfort while setting up and holding a shooting position, recreational shooters may not be familiar with or physically capable of certain shooting positions such as an entirely free standing pose, and may not be used to or comfortable with larger portions of the body in direct contact with the ground, such as the various prone and seated positions known and taught by professionals. Others may simply prefer not to get as dirty as they would by crouching or lying on soils or in mud.

Thus there is an interest in the sport shooting world for a field expedient and easily portable rifle rest for use where if a tree or an aptly sized column of rock, or a pole or other suitable natural formation is available. The above disadvantage is addressed by a rifle support with a leash having a loop end, an opposed free end, and an intermediate portion. The leash has a width and a plurality of spaced apart stoppers sized larger than this width. A hook comprises a suspension panel portion and a support portion offset from the suspension panel portion. The support portion includes an upward facing support surface when the suspension portion is vertical. The suspension panel has an elongated side edge and an upper end and a slot entering at the side edge. The slot width is greater than the leash but smaller than the stopper so as to admit the leash while denying passage of the stopper. The leash may be girded around a tree with its intermediate portion passing through the loop and the free end depending downward, with the hook slot receiving the leash and stopped by a stopper.

DETAILED DESCRIPTION OF A PREFERRED EMBODIMENT

The invention is a convenient, expedient, lightweight, stable, and portable shooting platform utilized to provide a stable shooting platform for hunters, tactical shooters or plinking. It was conceived when the inventor was preparing for an elk hunt in New Mexico. One of his shooting challenges was his level of ability to shoot long distance from a standing, unsupported position. Hunting primarily mountainous terrain, the invention was utilized by attaching to the numerous ponderosa pines in the area. Being a certified SWAT sniper, the inventor conducted further research and development during numerous field exercises and mission deployments and arrived at the configurations as described and disclosed herein.

The invention serves as a rifle support in that it comprises a leash having a loop end defining a passage and an opposed a free end. This portion may be fashioned with a long leash or cord with a loop or a bight tied at one end or an intermediate loop portion between the loop end and the free end. The leash has a width along its length which is usually the diameter of the leash or cord material. Given the weight of the typical rifle, a leash should preferably be able to withstand at least 20 to 30 pounds of tension. Parachute cord is another preferable material for a leash component. The leash includes stoppers along its intermediate length. A hook has a slot which receives a portion of the leash above one of the stoppers so that it will hang from the stopper point.

Figure 1:
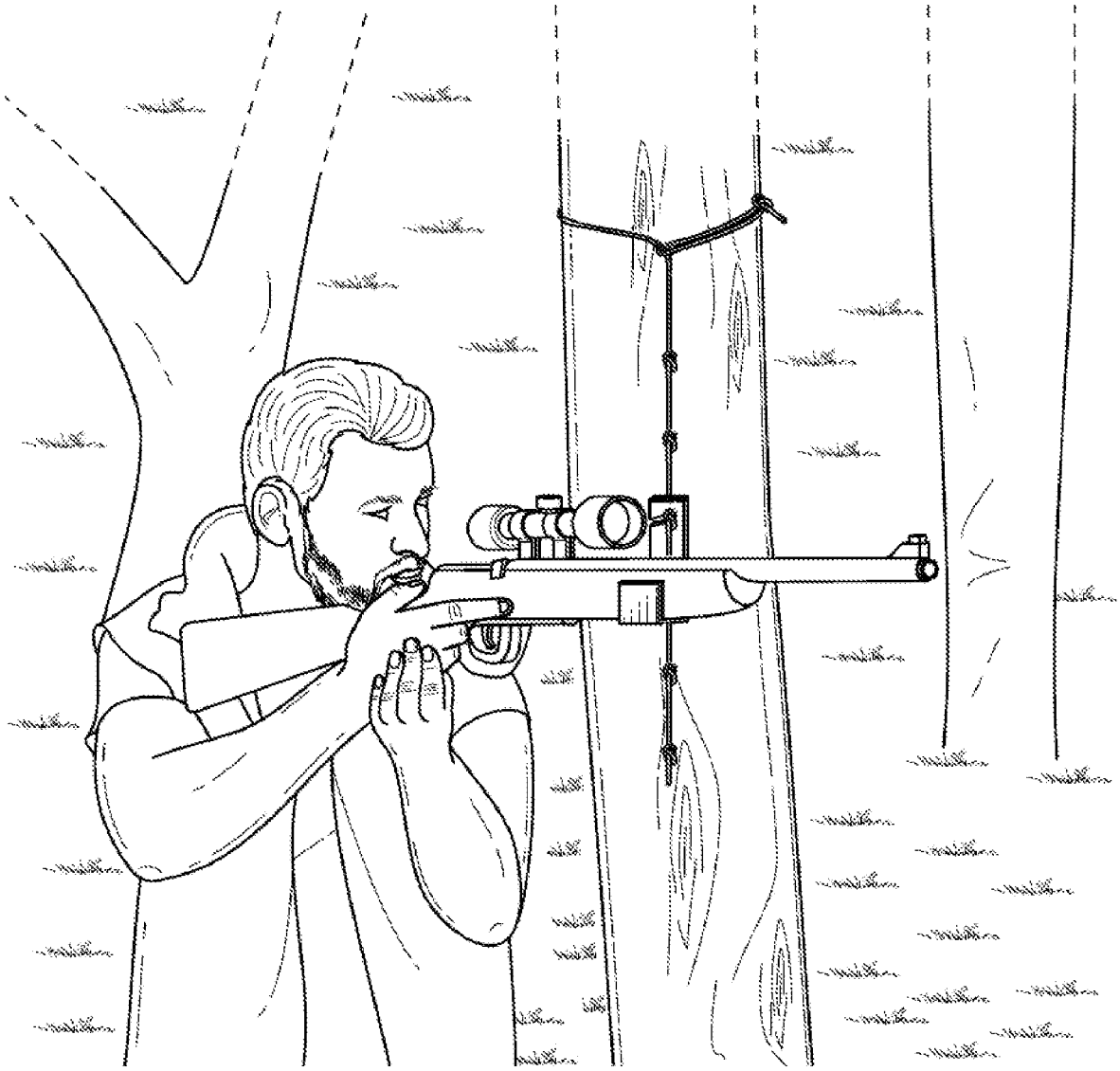
FIG. 1 is an environmental view of an embodiment a shooting assist platform in accordance with the invention being used by a shooter to support a rifle from a tree trunk.

Referring now to the figures, FIG. 1 is an environmental view of an embodiment a shooting assist platform in accordance with the invention being used by a shooter to support a rifle from a tree trunk.

Figure 2:
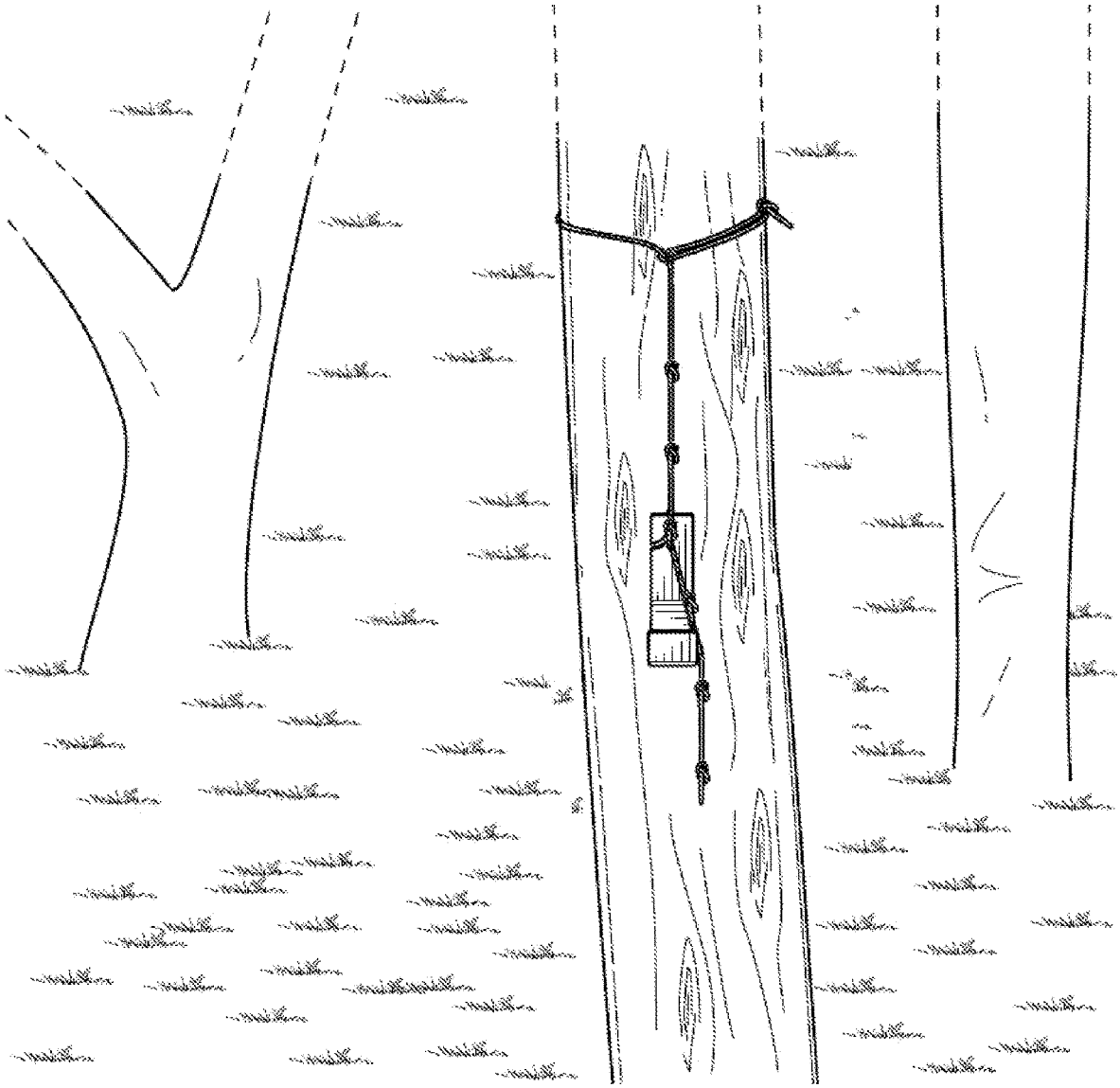
FIG. 2 is an environmental view of the shooting assist platform of FIG. 1 shown suspended from a tree trunk and ready for use.

FIG. 2 is an environmental view of the shooting assist platform of FIG. 1 shown suspended from a tree trunk and ready for use. In this illustration it will be readily understood that besides supporting a rifle or the forestock of a rifle, the invention may be used to hang a backpack, a target, or other sorts of outdoor sports equipment or supplies around a tree trunk, a cactus bole, or other substantially vertical structure. In this figure it is seen that the leash is configured to encompass a vertical support with an intermediate portion of the leash passing through the loop and the free end of the leash depending downward, and with a hook slot receiving the leash and stopped by one of the stoppers.

Figure 3A:
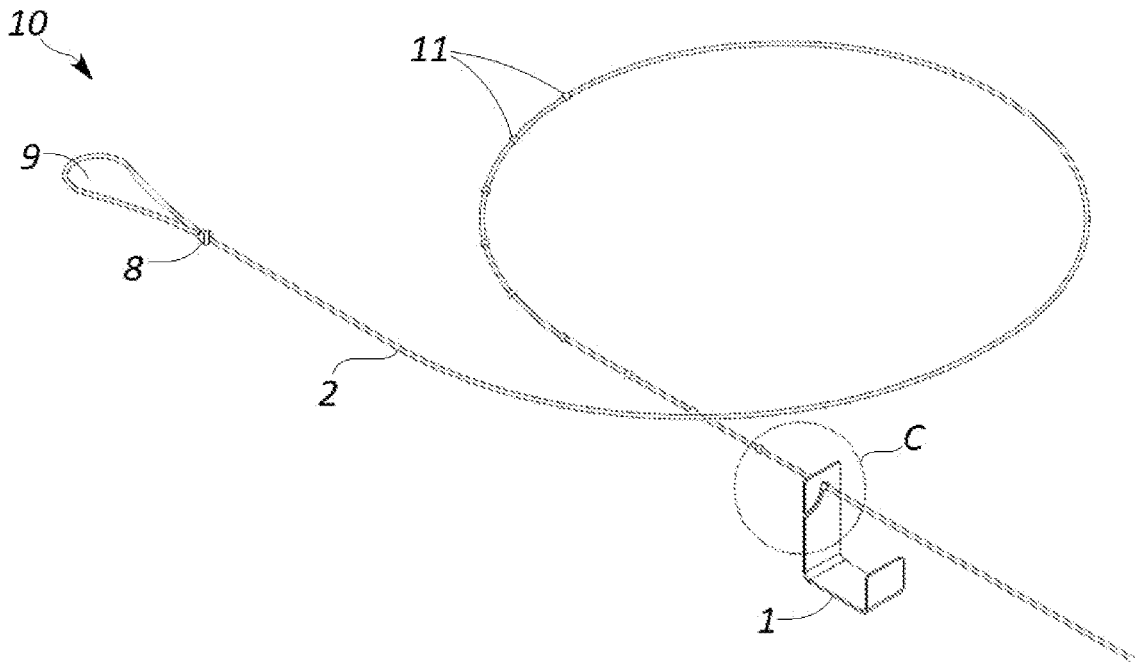
FIG. 3*a* shows an assembly of a kit of components of a shooting assist platform in accordance with the invention, including a phantom line boundary for Detail "C" of a portion of a support bracket shown in FIG. 3*c*.
Figure 3B:
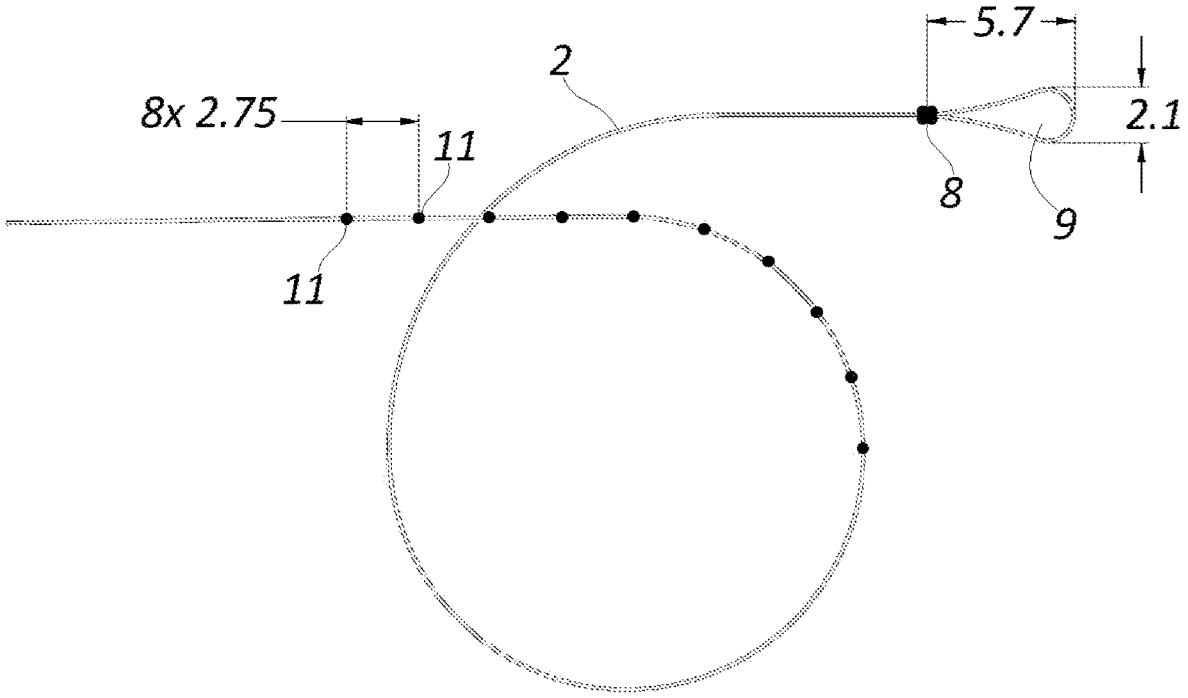
FIG. 3*b* shows a knotted leash component of a preferred embodiment of the invention which includes a bight at one end of the cord.
Figure 3C:
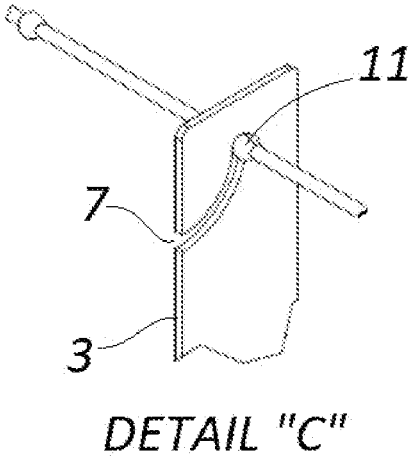
FIG. 3*c* shows a detail view "C" of a portion of the support bracket identified in FIG. 3*a*.

FIG. 3*a* shows an assembly [10] of a kit of components for a shooting assist platform in accordance with the invention, including a phantom line boundary for Detail "C" of a portion of a support bracket shown in FIG. 3*c*. The leash [2] has a loop end defining a passage [9] and an opposed a free end, and a plurality of spaced apart stoppers [11] having a width greater than the leash width. The loop may be formed by tying a bight in the end of the leash opposite from the free end. The knot [8] may be a bowline or preferably a double figure eight which is easier to untie than a double overhand knot. The other component is a hook [1] or hanger bracket.

FIG. 3*b* shows a knotted leash component [2] of a preferred embodiment of the invention which includes a loop or a bight [9] at one end of the cord. A preferable length for the overall untied length of the leash is bounded by a lower range of at least 28 inches but may be as great as 48 inches, and an upper range is at least 60 inches and may be as great as 170 inches. Within this range a preferable length of an untied leash is 85 inches. The loop or bight is preferably sized to pass the leash and its stoppers, and in some field conditions a smaller loop may increase the friction encountered when attempting to remove the leash after it has been secured to an upright structure or object. A lower size limit for dimensions of a passage defined by the loop is approximate to the diameter of the leash material itself, and an upper size limit would reside in a range between 36 inches and 48 inches in diameter. From among a plurality of useful and preferable shapes, a teardrop shaped loop having a breadth of 2.1 inches and a length of 5.7 inches is most preferable.

Stoppers [11] proximate the free end of the leash may be fashioned out of knots tied into the leash at intervals, or threaded onto the leash and tied around beads, or by overmolding or casting a plastic or resinous material at intervals along the leash. By using knots which may be untied or partially loosened as stoppers, fine control over the hanging height of the hook may be effected by loosening the knot slightly and feeding leash into it from one side of the knot, and then working the bulge of leash through the knot to pass out by the other side. A plurality of available and adjustable hanging points may be established along the length of the leash as shown in the figure. Although the invention may be used with only one such stopper, more convenience is offered when more stoppers are available for selecting the support height of the hook. In an exemplary embodiment shown, nine stoppers are shown spaced 2.75 inches apart. Spacing pitch for the stoppers need not be uniform. A lower limit for spacing between stoppers is the material thickness of the hook as it resides between the stoppers. For knots used as stoppers, an upper limit would be defined by the length from the loop knot [8] to the free end of the leash, minus the length of leash consumed by the knot.

FIG. 3*c* shows a detail view "C" of an upper portion of the hook [3] or support bracket identified in FIG. 3*a*. This portion of the hook is a generally planar member which when oriented for use includes a top edge from which a first and a second side edge descend. The first edge is interrupted by an entrant slot [7] which may be angularly oriented or as shown in a preferred embodiment, the slot includes a contour of which at least a portion is an arcuate contour. The slot width is greater that the leash width but less than the width of a stopper [11,] so as to admit and allow passage of the leash and to deny passage of the stopper. By preventing the stopper from passing through the slot, weight hanging from the hook may be transferred to and supported by the leash.

Although the width of the slot may be uniform along its contour, according to other embodiments within the scope of the invention, a slot may also include a first width less than the width of a stopper at the upper terminus of the contour and greater than the stopper width at some other portion or the entire remaining portion of the slot contour, so that the hook may be moved from one interval between stoppers to another by partially sliding the leash within the slot so it aligns with the wider section, rather than completely removing the hook from the leash for each such prepositioning of the hook along the leash. The lower terminus of the slot contour is its entry at the first edge, and is located more distant from the top of the hook than the upper terminus.

Figure 3D:
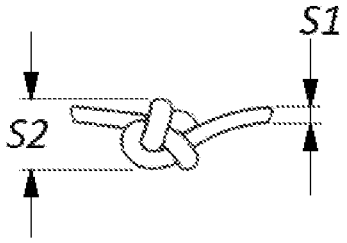
FIG. 3*d* shows an Ashley stopper knot.

FIG. 3*d* shows an Ashley stopper knot. The leash material has a width or diameter [S1] and a knot used as a stopper in the invention has a second width or effective diameter [S2] greater than [S1.] The hook slot width is preferably greater that [S1] but less than [S2,] but the slot width may be equal to or less than the leash width for leash materials which are compressible. Compared to other knots such as the overhand or figure eight knot, the Ashley stopper has one of the largest ratios of [S2] to [S1.]

Figure 4A:
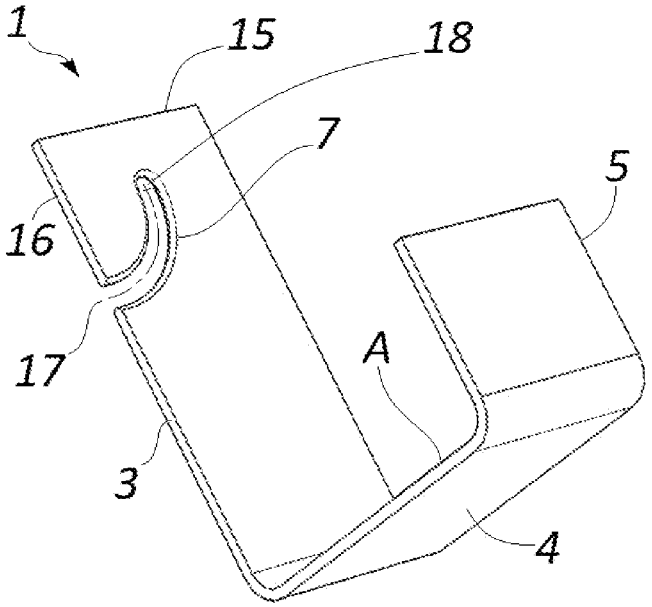
FIG. 4*a* shows a front left bottom view of an embodiment of a hook which is a support bracket as shown in FIG. 3*a*.

FIG. 4*a* shows a front left bottom view of an embodiment of a hook [1] which is a support bracket as shown in FIG. 3*a*. This kind of hook may be formed from sheetmetal. This hook has a suspension panel portion [3] and a support portion [4] angularly offset from the suspension panel portion. The support portion has an upward facing support surface [A] when the suspension portion is vertical. The suspension panel has an elongated side edge [16] and an upper end [15,] and the suspension panel defines a slot [7] having an entrance [17] at the side edge and a closed upper end [18] proximate the upper end. A prong portion [5] of the hook spaced apart from the suspension panel retains an object being suspended, such as the forestock of a rifle or a top handle or loop of a backpack, or a sling of a carry bag. The prong or upturned distal portion of the support bracket prevents the suspended object from sliding off the end of the support portion.

Figure 4B:
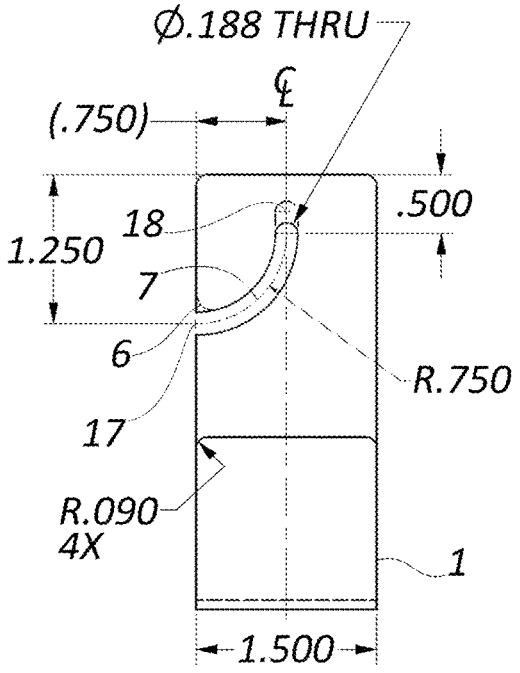
FIG. 4*b* shows a front view of the support bracket of FIG. 3*a* and some exemplary dimension values for features visible in this view, including an arcuate slot.

FIG. 4*b* shows a front view of the support bracket [1] of FIG. 3*a* and some exemplary dimension values for features visible in this view, including an arcuate slot which enters perpendicular to a side wall so the contour of the slot is at its entrance is at least 80° from the direction of the edge. Although a 90° or perpendicular entry of the slot contour may be most preferred, the slot [7] may be formed with a contour at this entrant point as acute as 20° from the direction of the edge. In this set of embodiments illustrated, the slot is arcuate or at least includes an arcuate portion of which an entrance [17] resides below the closed end [18,] and bends concave in an upward direction toward the closed end. The sides of the slot at this lower terminus have an acute corner [6] and an obtuse corner.

When the tangent angle of the slot contour is a particularly acute angle, then the acute corner may disadvantageously act as an incising tooth upon the leash material, and it may be preferable to round off the acute corner as shown by the broken line. When fashioned from sheetmetal, this rounding may be part of a general deburring process which includes rounding off the other corners as well and breaking other sharp edges. Also, according to specific embodiments within the scope of the invention, the slot contour may terminate at the centerline width or midplane of the bracket as shown, but this configuration while aesthetic, is not a necessary condition. The slot contour may also terminate at a tangent to its arcuate portion, with the tangent end portion of the contour being vertical as shown or nearly so, or may also terminate at a point not residing on the centerline of the material width of the bracket. Depending on the configuration of a sheet metal press for stamping the slot, and how the punch tooling is to be formed, it may be easier to configure or more economical in production for the slot to continue in a short, straight line beyond the arcuate portion of the slot contour. These variations in form reside within the scope of the invention and the exact details may be determined by consultation with a tool and die designer depending on the production limitations of one facility or another.

The dimension values shown in the figure are exemplary values of a preferred embodiment. The overall width dimension may vary from as narrow as three times the width of the leash to as large as 10 inches. Also, although preferable, the upper end of the slot need not reside coincident with the centerline of the width of the support bracket, however this is preferable because the bracket when hanging vertically will present a horizontal support portion for the forestock of a rifle being sighted onto a target. The minimum value for the dimension from the upper edge of the bracket to the top of the slot is limited by the shear strength of the bracket material in withstanding a shear load of the weight of the supported object acting through the cross section of material remaining between the upper edge of the bracket to the top of the slot. The difference in dimension values between the distance from the upper edge of the bracket to the top of the slot versus from the upper edge of the bracket to the entry point of the slot at the side edge of the bracket is predicated by being sufficient to prevent typical lateral loads, such as recoil of the rifle during shooting, from enabling the leash to escape from its held position at the top of the slot by traversing the length of the slot in response to such lateral impulses. Similarly, preferred embodiments of a slot contour have its upper end trending vertical or at or near vertical, which being a direction orthogonal to recoil, isolates a recoil impulse from a force direction likely to dislodge the leash from its held position at the top of the slot. The tangent of the contour of the upper end of the slot may also be at or near vertical, and preferably coincides with the line of symmetry or centerline of the bracket.

Figure 4C:
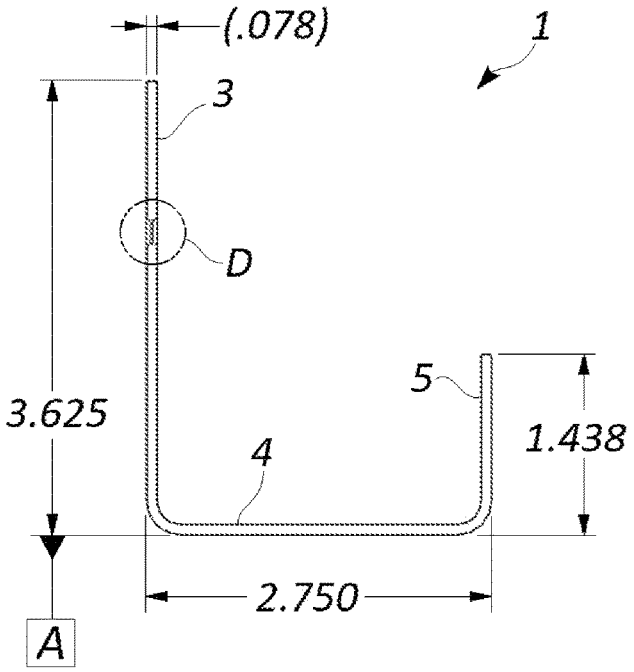
FIG. 4*c* shows a left side elevation view of the support bracket of FIG. 3*a* and some exemplary dimension values for features visible in this view, and includes a phantom line boundary for Detail "D" of a side view of a terminus of the arcuate slot of this component.

FIG. 4*c* shows a left side elevation view of the support bracket [1] of FIG. 3*a* and some exemplary dimension values for features visible in this view, and includes a phantom line boundary for Detail "D" of a side view of a terminus of the arcuate slot of this component. The hook has a vertical ledge panel [5] opposite the suspension panel [3] and spaced apart from the suspension panel by a selected spacing configured to admit a rifle. The lower end value of this spacing dimension value may range between ½ inch and % inch for accommodating the rifle barrel of certain small-bore rifles such as air rifles, and may range as wide as 8 to 10 inches wide to accommodate large-bore rifles and in certain uses to allow accessory equipment to be supported in tandem with the rifle such as a flashlight or a rangefinder. In this sort of embodiment the bracket may serve as a shelf and not just a hook.

The height of the distal wall or vertical ledge panel is preferably tall enough to impede a supported object from sliding off the end of the support portion [4,] especially when in some conditions the support surface provided by the bracket may not be level. A minimum height range for the wall may reside between ¼ inch and ½ inch, being just sufficient to catch a sliding object headed over the edge of the support surface, and a maximum height range may reside between a value equal to the height of the support panel and another value being the sum of the support panel height plus the spacing width between the suspension panel and this vertical ledge panel, because a height taller than this sum may disadvantageously induce tipping of the bracket when it is not under load.

Figure 4D:
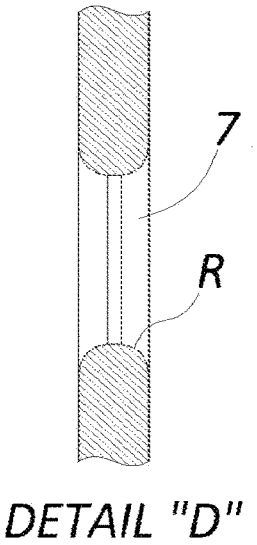
FIG. 4*d* shows an enlargement of the portion of the support bracket enclosed by the phantom line boundary in FIG. 4*c* defining Detail "D."

FIG. 4*d* shows an enlargement of the portion of the support bracket enclosed by the phantom line boundary in FIG. 4*c* defining Detail "D." The material edge of the side of the support bracket is shaded to better illustrate the slot entrance. In this view it is seen that in preferable embodiments the edges of the slot [7] are de-burred or filleted to a radius [R] up to half the material thickness to produce a half-round interior surface. This condition is preferable in that it reduces chafing of the leash while in use.

Figure 4E:
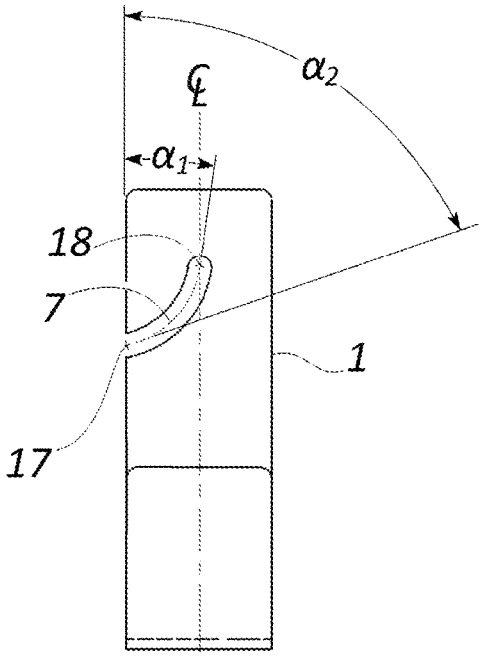
FIG. 4*e* shows a front view of an alternative embodiment of a hook which is a support bracket in accordance with the invention as shown in FIG. 3*a*.

FIG. 4*e* shows a front view of an alternative embodiment of a hook [1] which is a support bracket in accordance with the invention as shown in FIG. 3*a*. The hook includes a slot [7] which in this embodiment is arcuate and concave upwards, and has an entrance [17] at a side edge of the hook and a closed upper end [18] proximate the upper end hook. The slot entrance is at a level below its closed end. In alternative embodiments a tangent line taken at the end of the slot contour is nearly vertical but not so, and the upper end point of the contour of the slot is close to but does not coincide with the centerline or midplane of the hook. The slot may also traverse the centerline and terminate opposite the centerline from the entrant edge. The slot at its upper end is angularly offset from vertical by a first angle [$\alpha_1$] and is angularly offset from the vertical by a greater second angle [$\alpha_2$] at the entrance of the slot where it originates at the side of the hook. Although less preferable than the embodiment shown in FIG. 4*b*, this sort embodiment resides within the scope of the invention as allowable within production tolerances or functional tolerances, especially for a hook designed and dimensioned using Geometric Dimensioning and Tolerancing (GDT) symbols which specify and control allowable forms as related to the desired functionality of the part rather than traditional witness line dimensioning and tolerance specifications.

Many modifications and variations on the present disclosure may be made and other methods performed without departing from its spirit and scope. Thus, although a plurality of exemplary embodiments are described above, it will be appreciated that the invention is intended to cover all modifications and equivalents within the scope of the following claims.

I claim:

1. A rifle support comprising;

a leash having a loop end defining a passage and an opposed a free end, with an intermediate loop portion therebetween;

the leash having a leash width along its length;

the leash having a plurality of spaced apart stoppers having a width greater than the leash width;

a hook having a suspension panel portion and a support portion angularly offset from the suspension panel portion, the support portion having an upward facing support surface when the suspension portion is vertical;

the suspension panel having an elongated side edge and an upper end;

the suspension panel defining a slot having an entrance at the side edge and a closed upper end proximate the upper end;

a slot width greater that the leash width, and less than the stopper width so as to admit and allow passage of the leash and to deny passage of the stopper, and wherein the leash is configured to encompass a vertical support with the intermediate portion passing through the loop and the free end depending downward, with the hook slot receiving the leash and stopped by one of the stoppers.

2. The rifle support of claim 1, wherein the stoppers are proximate the free end of the leash.

3. The rifle support of claim 1, wherein the hook has a vertical ledge panel opposite the suspension panel and spaced apart from the suspension panel by a selected spacing configured to admit a rifle.

4. The rifle support of claim 1, wherein the slot entrance is at a level below the closed end.

5. The rifle support of claim 1, wherein the slot is arcuate.

6. The rifle support of claim 5, wherein the slot is concave upwards.

7. The rifle support of claim 1, wherein the slot at the upper end is angularly offset from vertical by a first angle, and is angularly offset from the vertical at the entrance by a greater second angle.

8. The rifle support of claim 1, wherein the slot at the upper end is vertical.

9. The rifle support of claim 1, wherein the slot at the upper end is tangent to vertical.

* * * * *